US011221124B1

(12) United States Patent
Ryan

(10) Patent No.: US 11,221,124 B1
(45) Date of Patent: Jan. 11, 2022

(54) LIGHTING ACCESSORY FOR THE SELECTIVE REDUCTION OF GLARE

(71) Applicant: Glare Shield, Marietta, GA (US)

(72) Inventor: Leo William Ryan, Marietta, GA (US)

(73) Assignee: GLARE SHIELD, Marietta, GA (US)

( * ) Notice: Subject to any disclaimer, the term of this patent is extended or adjusted under 35 U.S.C. 154(b) by 0 days.

(21) Appl. No.: 17/241,602

(22) Filed: Apr. 27, 2021

(51) Int. Cl.

| | |
|---|---|
| ***F21V 1/10*** | (2006.01) |
| ***F21V 21/04*** | (2006.01) |
| ***F21S 8/02*** | (2006.01) |
| ***F21V 14/04*** | (2006.01) |

(52) U.S. Cl.
CPC ..... *F21V 1/10* (2013.01); *F21S 8/026* (2013.01); *F21V 14/04* (2013.01); *F21V 21/047* (2013.01); *F21V 21/049* (2013.01)

(58) Field of Classification Search
CPC . F21V 1/10; F21V 14/04; F21V 21/04; F21V 21/041; F21V 21/047; F21V 21/049; F21S 8/02; F21S 8/026; F21S 8/04
USPC ..... 362/147, 148, 150, 359, 364, 433
See application file for complete search history.

(56) References Cited

U.S. PATENT DOCUMENTS

| | | | | |
|---|---|---|---|---|
| 4,475,147 | A * | 10/1984 | Kristofek | F21S 8/026 362/147 |
| 5,651,606 | A * | 7/1997 | Krogman | F21V 31/00 362/267 |
| 7,198,391 | B2 * | 4/2007 | Rutchik | F21S 8/02 362/359 |
| 7,789,540 | B2 * | 9/2010 | Gordin | F21S 8/086 362/359 |
| 7,874,706 | B2 * | 1/2011 | Carle, Jr. | F21S 8/02 362/359 |
| 2006/0193138 | A1 * | 8/2006 | Montefusco | F21V 11/00 362/359 |

* cited by examiner

*Primary Examiner* — Laura K Tso
(74) *Attorney, Agent, or Firm* — Gronholm Patent Services

(57) ABSTRACT

A device and the method of installing and adjusting same, which provides reduction of glare from overhead lighting, including but not limited to "can" lighting, also referred to as recessed lighting.

14 Claims, 8 Drawing Sheets

Shield Element 10 slides into place and snaps behind annular lip of Can Light Assembly 5 installed in Ceiling 3

REFLECTION BLOCKED

SHIELD ELEMENT 10 – Various views (upside down from installed position)

(upside down from installed position)

SHIELD ELEMENT
10

Bottom Plan View
Picture is to scale

LIGHTING ACCESSORY FOR THE SELECTIVE REDUCTION OF GLARE

FIELD

This disclosure relates to the reduction of glare from overhead lighting, including but not limited to "can" lighting, also referred to as recessed lighting.

SUMMARY OF THE INVENTION

This section provides some introduction to various matters relating to the invention mentioned herein, but it should be understood that this should not be construed as prior art to the invention; certain materials may be included, referenced, or alluded to in this section that may be inventions of the inventors noted herein. This section is simply included to include some introduction for the sake of the reader, some of which may be background to the invention, and some which is not.

Glare from overhead lighting is a known problem, especially glare from overhead can lighting onto vertical shiny surfaces such as television screens. Often the use of such overhead can lighting cannot be used in conjunction with television watching, which can also cause inconvenience.

It is known to provide shields for outside lighting such as shown in FIG. 9, but such shields have limitations due to their fixed nature (see the three holes for fixing screws).

Therefore, a need exists for improvements over the prior art.

Therefore, the present invention provides a shield than can attach to and rotate around a stationary can light to provide directionally adjustable shielding while the can light does not move.

The present invention further provides the concept noted immediately above, with the rotation being provided by the use of an annular channel which fits on the circular flange of a can light and allows for sliding rotation between the two.

The present invention further provides the concept noted immediately above, with the shielding being provided by a truncated tube which has a gap on one side, has a high part on the other side, and an angled free edge.

The present invention further provides an attachment to a stationary recessed overhead can light, said light providing direct illumination into an illumination zone, said attachment comprising: A) a shielding portion configured to shield a portion of said light; and B) an attachment portion configured to attach to said recessed overhead can light, such that said shield while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment is in said first rotational position, said shielding portion of said attachment acts as a shield to block direct illumination into a given section of said illumination zone, such that when said attachment is in said second rotational position, said shielding portion of said attachment does not act as a shield to block direct illumination into said given section of said illumination zone, such that rotation of said attachment provides directionally adjustable shielding from said illumination.

The present invention further provides the attachment to a stationary recessed overhead can light as described above, wherein said shield element includes a longer portion that when in an installed position extends further downwardly than the remainder of said attachment, said longer element providing said directionally adjustable shielding.

The present invention further provides the attachment to a stationary recessed overhead can light as described above, wherein said rotation may be provided by manual adjustment.

The present invention further provides the attachment to a stationary recessed overhead can light as described above, wherein said attachment may be used with 4 or 6 inch overhead can lights.

The present invention further provides the attachment to a stationary recessed overhead can light as described above, wherein said attachment may be used with 4 or 6 inch overhead can lights.

The present invention further provides an attachment to a stationary recessed overhead can light, said light providing direct illumination into an illumination zone, said stationary recessed can light including a lower annular lip having a substantially circular outer free edge, said attachment comprising: A) a shielding portion configured to shield a portion of said light, B) an attachment portion configured to attach to said recessed overhead can light, said attachment portion including an inwardly directed truncated annular channel portion configured to fit around the exterior of said outer free edge of said can light, said circular lip and said annular channel mating together to facilitate a connection as well as to facilitate rotational sliding between the two, such that said shield while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment is in said first rotational position, said shielding portion of said attachment acts as a shield to block direct illumination into a given section of said illumination zone, such that when said attachment is in said second rotational position, said shielding portion of said attachment does not act as a shield to block direct illumination into said given section of said illumination zone, such that rotation of said attachment provides directionally adjustable shielding from said illumination.

The present invention further provides the attachment to a stationary recessed overhead can light as described above, wherein said shield element is a portion of a tube including a longitudinal center axis, wherein said free edge lies in a common plane that is not perpendicular to said center axis, but is instead at an acute angle to such a perpendicular plane.

The present invention further provides the attachment to a stationary recessed overhead can light as described above, wherein said shield element includes a longer portion that when in an installed position extends further downwardly than the remainder of said attachment, said longer element providing said directionally adjustable shielding.

The present invention further provides the attachment to a stationary recessed overhead can light as described above, wherein said rotation may be provided by manual adjustment.

The present invention further provides the attachment to a stationary recessed overhead can light as described above, wherein said attachment may be used with 4 or 6 inch overhead can lights.

The present invention further provides the attachment to a stationary recessed overhead can light as described above, wherein said attachment may be used with 4 or 6 inch overhead can lights.

The present invention further provides an attachment to a stationary recessed overhead can light, said light providing direct illumination into an illumination zone, said stationary recessed can light including a lower annular lip having a substantially circular outer free edge, said attachment comprising: A) a shielding portion configured to shield a portion of said light, said shielding portion having a substantially cylindrical shape except for a gap in its circumference running the length of the shielding portion; and B) an attachment portion configured to attach to said recessed overhead can light, said attachment portion including an inwardly directed truncated annular channel portion configured to fit around the exterior of said outer free edge of said can light, said circular lip and said annular channel mating together to facilitate a connection as well as to facilitate rotational sliding between the two, such that said shield while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment is in said first rotational position, said shielding portion of said attachment acts as a shield to block direct illumination into a given section of said illumination zone, such that when said attachment is in said second rotational position, said shielding portion of said attachment does not act as a shield to block direct illumination into said given section of said illumination zone, such that rotation of said attachment provides directionally adjustable shielding from said illumination, said attachment portion having a gap in its circumference being in substantial alignment with said gap in said shielding portion, said shielding portion and said attachment portion being flexible to facilitate allow said gap to widened during installation and then to snap back, allowing said attachment portion to be snap-fitted around said widening of said gap allowing for its installation onto said substantially circular outer free edge of said lower annular lip of said stationary recessed can light.

The present invention further provides the attachment to a stationary recessed overhead can light as described above, wherein said shield element is a portion of a tube including a longitudinal center axis, wherein said free edge lies in a common plane that is not perpendicular to said center axis, but is instead at an acute angle to such a perpendicular plane.

The present invention further provides the attachment to a stationary recessed overhead can light as described above, wherein said shield element includes a longer portion that when in an installed position extends further downwardly than the remainder of said attachment, said longer element providing said directionally adjustable shielding.

The present invention further provides the attachment to a stationary recessed overhead can light as described above, wherein said rotation may be provided by manual adjustment.

The present invention further provides the attachment to a stationary recessed overhead can light as described above, wherein said attachment may be used with 4 or 6 inch overhead can lights.

The present invention further provides the attachment to a stationary recessed overhead can light as described above, wherein said attachment may be used with 4 or 6 inch overhead can lights.

The present invention further provides a method of attaching an attachment to a stationary recessed overhead can light, said light providing direct illumination into an illumination zone, said stationary recessed can light including a lower annular lip having a substantially circular outer free edge, said method comprising: A) providing a shielding portion configured to shield a portion of said light, said shielding portion having a substantially cylindrical shape except for a gap in its circumference running the length of the shielding portion; and B) providing an attachment portion configured to attach to said recessed overhead can light, said attachment portion including an inwardly directed annular channel configured to fit around the exterior of said outer free edge of said can light, said circular lip and said annular channel mating together to facilitate a connection as well as to facilitate rotational sliding between the two, such that said shield while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment is in said first rotational position, said shielding portion of said attachment acts as a shield to block direct illumination into a given section of said illumination zone, such that when said attachment is in said second rotational position, said shielding portion of said attachment does not act as a shield to block direct illumination into said given section of said illumination zone, said attachment portion having a gap in its circumference being in substantial alignment with said gap in said shielding portion, said shielding portion and said attachment portion being flexible to facilitate allow said gap to widened during installation and then to snap back, allowing said attachment portion to be snap-fitted around said widening of said gap allowing for its installation onto said substantially circular outer free edge of said lower annular lip of said stationary recessed can light, and C) rotating said attachment such that it provides directionally adjustable shielding from said illumination.

The present invention also provides methods of using all shields described herein in order to provide directionally adjustable shielding.

These and other aspects will become readily apparent upon further review of the following specification and drawings. Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 2A shows the use of an overhead can light 5 without any shielding, with light reflecting from a wall mounted TV screen 6 or other similarly oriented reflective surface, to the detriment of the typical viewer 2. It may be understood that in this situation, the light provides direct illumination which reflects in the reflective surface.

FIG. 2B shows the use of the shield element 10 according to an embodiment of the present invention, said shield including a portion blocking light which would ordinarily reflect from a wall mounted TV screen 6 or other similarly oriented reflective surface, thus providing an improved experience for the typical viewer 2. It may be understood that the lowest part of the shield element 10 is adjusted to be directed to the viewer's right in this figure, and the gap, discussed elsewhere, is to the viewer's left in this figure. It may be understood that in this situation, the shield element 10 blocks the direct illumination of the light that reaches and reflects from the reflective surface. Said another way, a shielding portion of the attachment acts as a shield to block direct illumination into a given section of the direct illumination zone of the direct light.

DETAILED DESCRIPTION

Introduction

The present invention now will be described more fully hereinafter with reference to the accompanying drawings, in which some, but not all embodiments of the inventions are shown. This invention may be embodied in many different forms and should not be construed as limited to the embodiments set forth herein; rather, these embodiments are provided so that this disclosure will satisfy applicable legal requirements. Like numbers refer to like elements throughout.

Reference is now made to the figures, in which like elements indicate like elements throughout the several views.

ELEMENT LIST

Here is a list of the various elements:

2 Typical viewer
3 Ceiling Having Downwardly Facing Surface
5 Can Light Assembly
  5-L Can Light Lip
6 Wall Mounted TV Screen
10 Shield Element
  12 Shield Channel Portion
  14 Arcuate wall
  16 free edge

DETAILED DISCUSSION

Basic Operation and Construction

Figure 1:
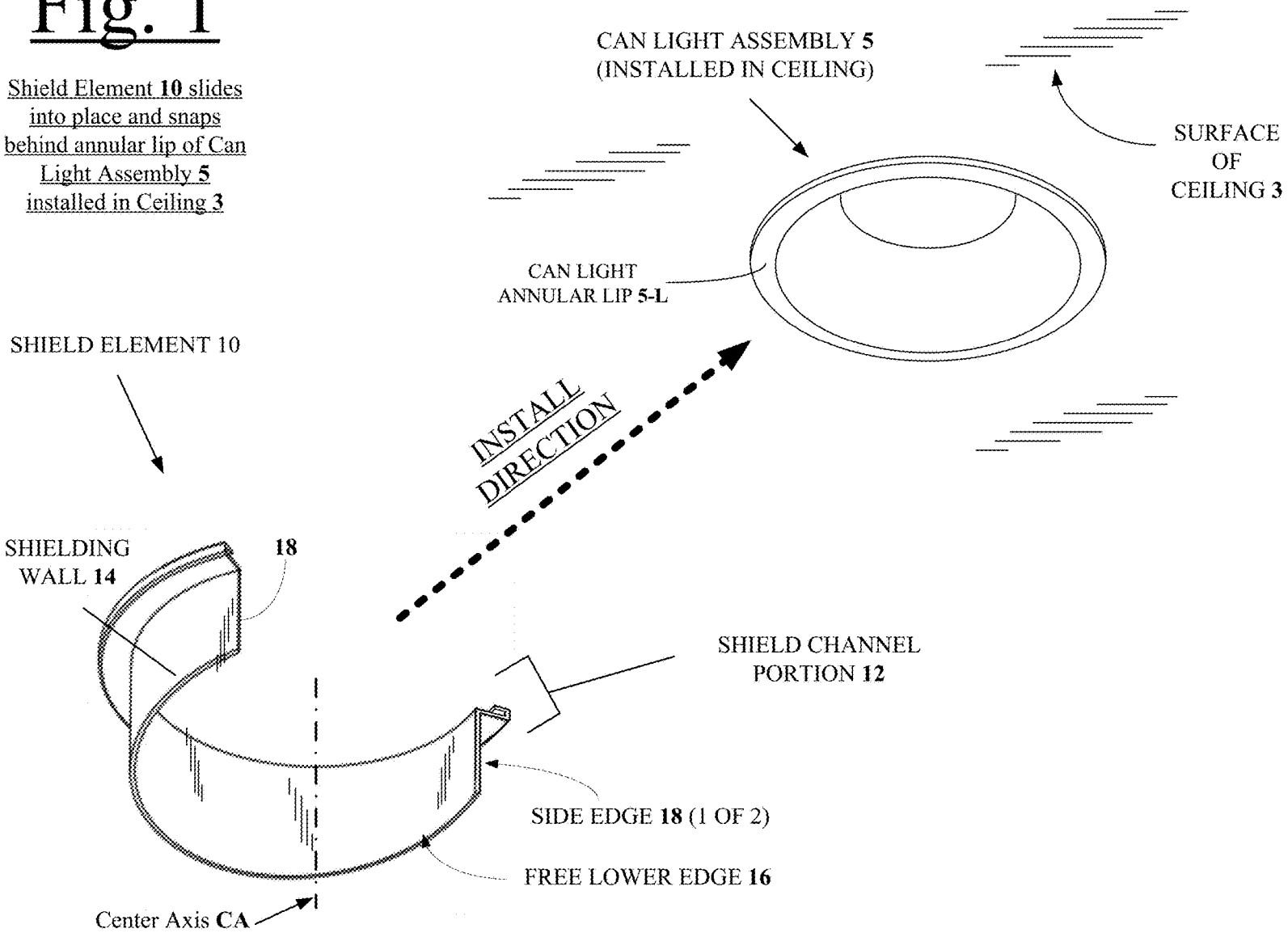
FIG. 1 is a pictorial view illustrating installation of the shield element 10 onto a can light assembly 5 installed in a ceiling 3 having a downwardly directed planar surface such as that provided by sheetrock or other suitable paneling. The dotted line shows the install direction as the shield element 10 is flexed and snapped into place onto a conventional can light assembly 5.

Reference is now made to FIG. 1, which is an illustrative description of an overview and summary of one aspect of the present inventions. FIG. 1 is a pictorial view illustrating installation of the shield element 10 onto a can light assembly 5 installed in a ceiling having a downwardly directed planar surface 3 such as that provided by sheetrock or other suitable paneling. The dotted line shows the install direction as the shield element 10 is snapped into place onto a can light assembly 5.

Figure 3:
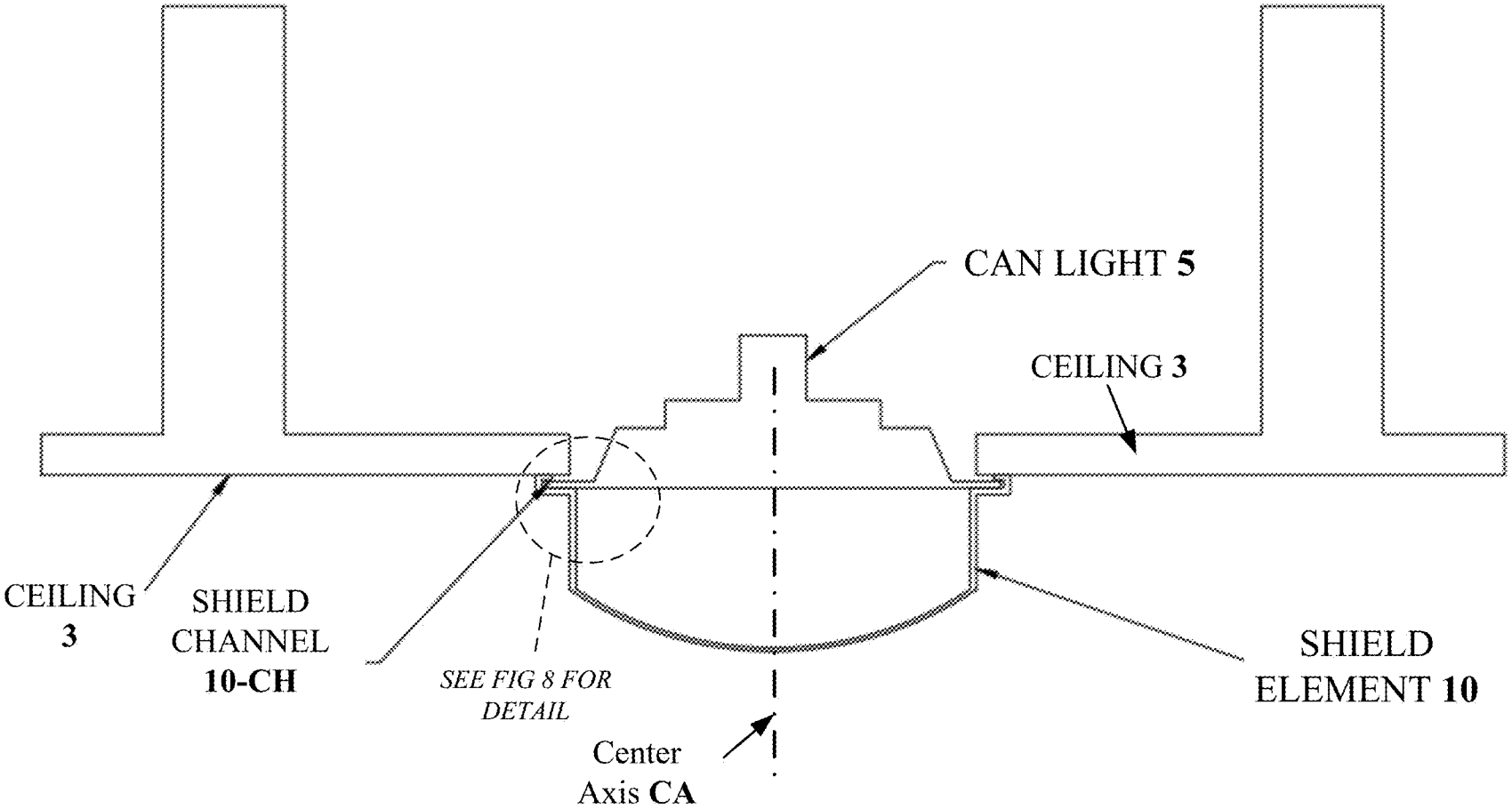
FIG. 3 is a side elevational illustrative view showing the installation of the can light 5 in a typical ceiling 3 having a downwardly facing surface, with the shield element 10 positioned in place by sliding the channel portion 12 of the shield element 10 around the annular lip of the can light 5, as described in detail further. In this figure, the shield element 10 is in cross section, and the highest side (the side providing the most light shielding) is at the back, relative to the viewer of the figure. The front side having the gap cut through is not shown due to cross sectioning.

The shield element 10 may be thought as being a ring-like shape with a center axis along Center Axis CA of FIG. 3, with a section cut out of the ring to provide a longitudinally extending gap (in that the gap runs the entire length of the element). The remainder of the ring includes a shield channel portion 12 which snaps onto and fits around the annular lip of the can light assembly which typically protrudes downwardly underneath the surface of a ceiling 3.

Once installed, the shield element 10 can be rotated about its center axis CA to provide directional shielding as desired.

Further details on construction and use are below.

Shield Element 10 Details

The shield element 10 is in one configuration of a single piece design that may be provided by injection molding, although other processes are likewise contemplated without departing from the spirit and scope of the present invention. Multi-piece configurations are likewise contemplated although not shown.

The shield element 10 includes a shield channel portion 12 as well as an arcuate shielding wall 14 extending from the shield channel portion 12. The shielding wall 14 terminates at a free edge 16 at its lower end, and is defined on its sides by two side edges 18. The two side edges 18 are spaced by a longitudinally extending gap in the shield element 10 as described in detail elsewhere.

Figure 5:
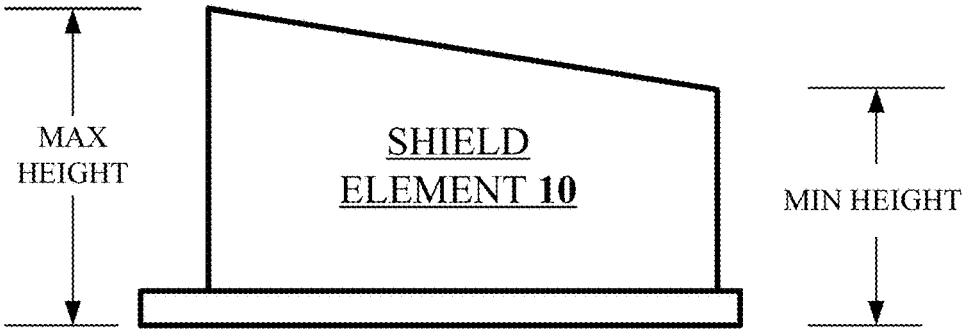
FIG. 5 is an elevational side view of shield element, showing its maximum and minimum heights (aka longer and shorter lengths or longer and shorter portions), of which certain examples are provided elsewhere in this application.
Figure 6:
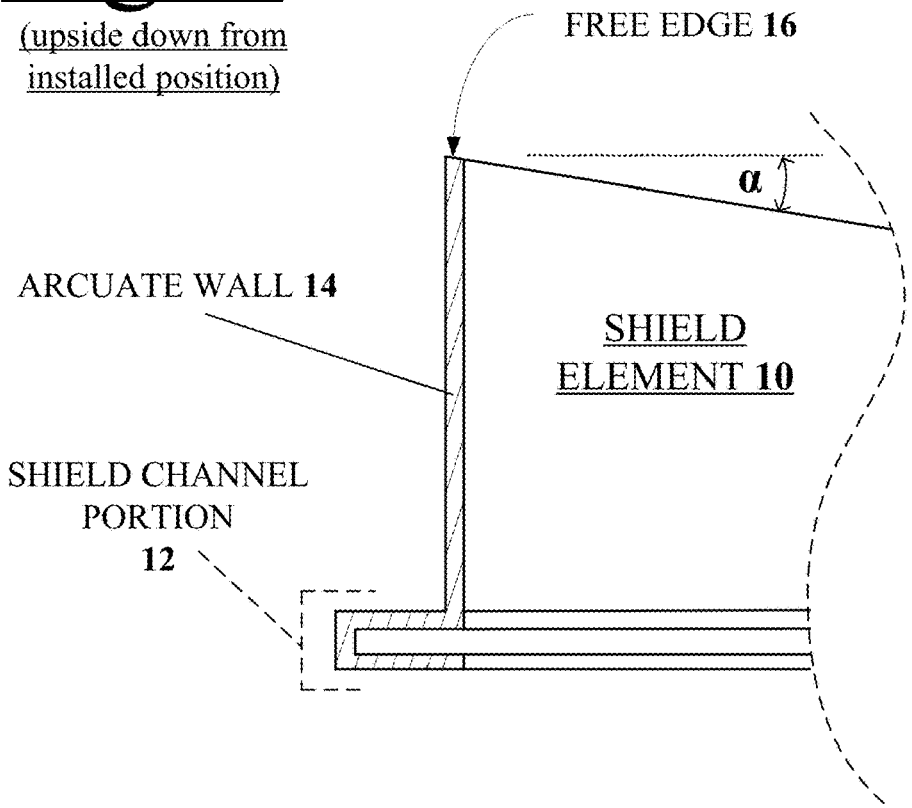
FIG. 6 is a more detailed, partial cross section of that shown in FIG. 5, showing the cross section of the shield channel portion 12 of the shield element 10.

The free edge 16 in the embodiment shown lies in a common plane that is not perpendicular to the center axis CA of the shield element 10, but is instead at an acute angle to such a perpendicular plane. This angle is shown as Alpha or "a" in FIG. 6. This angle α of taper results in the arcuate wall 14 having a higher side and a lower side (when the element is viewed in its upside down position as in this figure). This is shown in reference to FIG. 5, which shows an elevational side view of the shield element, showing its maximum and minimum heights (aka maximum and minimum lengths), of which certain examples are provided elsewhere in this application. In this view the higher side is to the left of the viewer, and on the left side of the element 10 as viewed by the viewer. In this view the gap between the two side edges 18 is to the right of the viewer.

Figure 4:
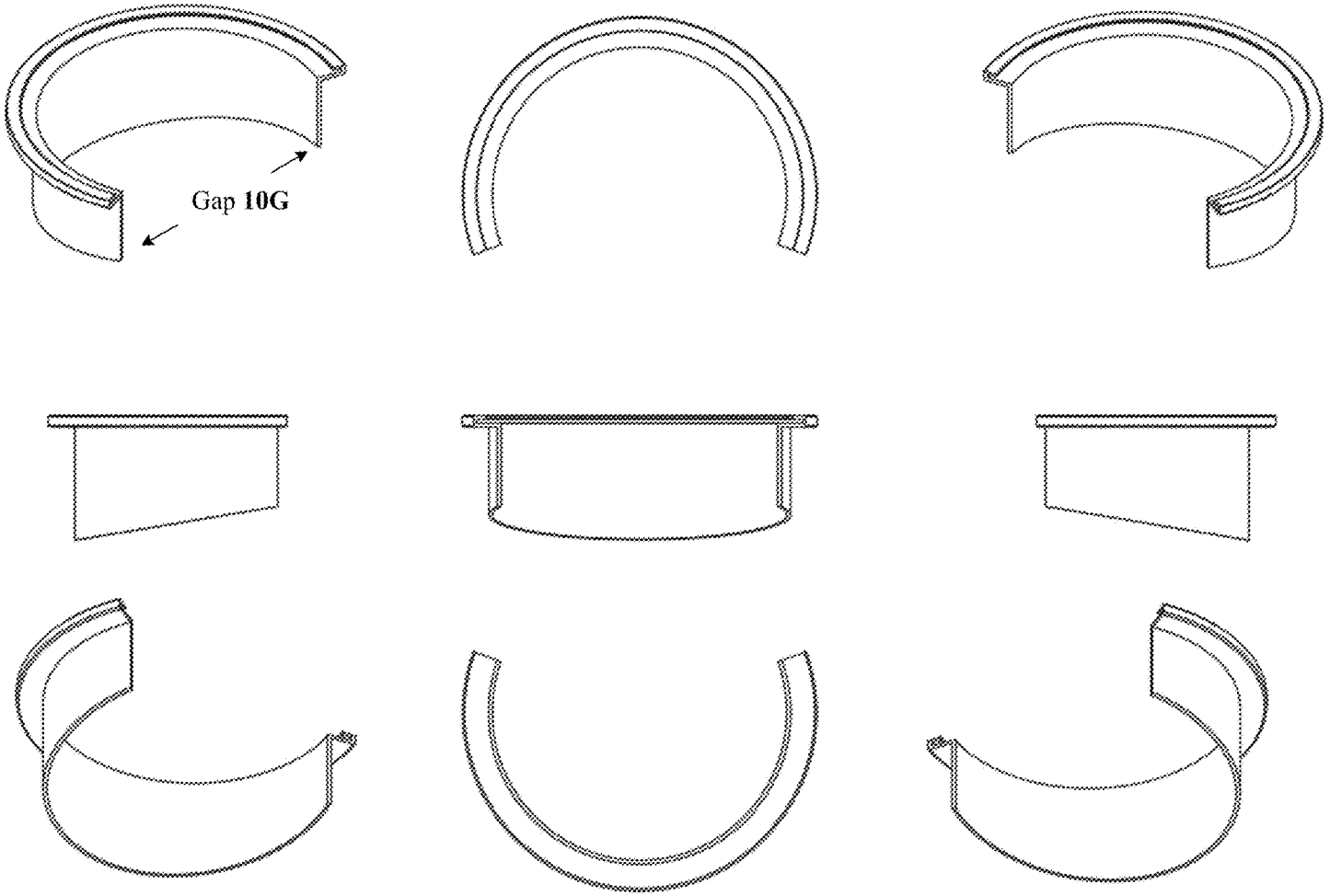
FIG. 4 shows various views of the one piece shield element 10. The various lengths, dimensions and angles therein include ornamental features, so other lengths, dimensions and angles are contemplated in this utility patent application without departing from the spirit and scope of the present invention. This particularly includes the angled shape of the arcuate wall.

The shield element 10 may be thought as being a "stepped" cylindrical shape with a center axis along Center Axis CA of FIGS. 1 and 3, with a longitudinally extending section cut out of the stepped cylindrical shape along a cut line being parallel to but spaced apart from the Center Axis CA. This cut out section may be thought of as leaving a longitudinally extending "gap", between the two side edges 18. This gap is labelled as 10G in one of the views of FIG. 4. The thus modified stepped cylindrical shape includes the shield channel portion 12 (which itself has the gap) and the shielding wall 14 (which likewise has the gap). The channel portion 12 may be thought of as a portion of an annular, inwardly directed, channel with a gap therein. It may also be thought of as a "truncated annular channel".

Figure 8:
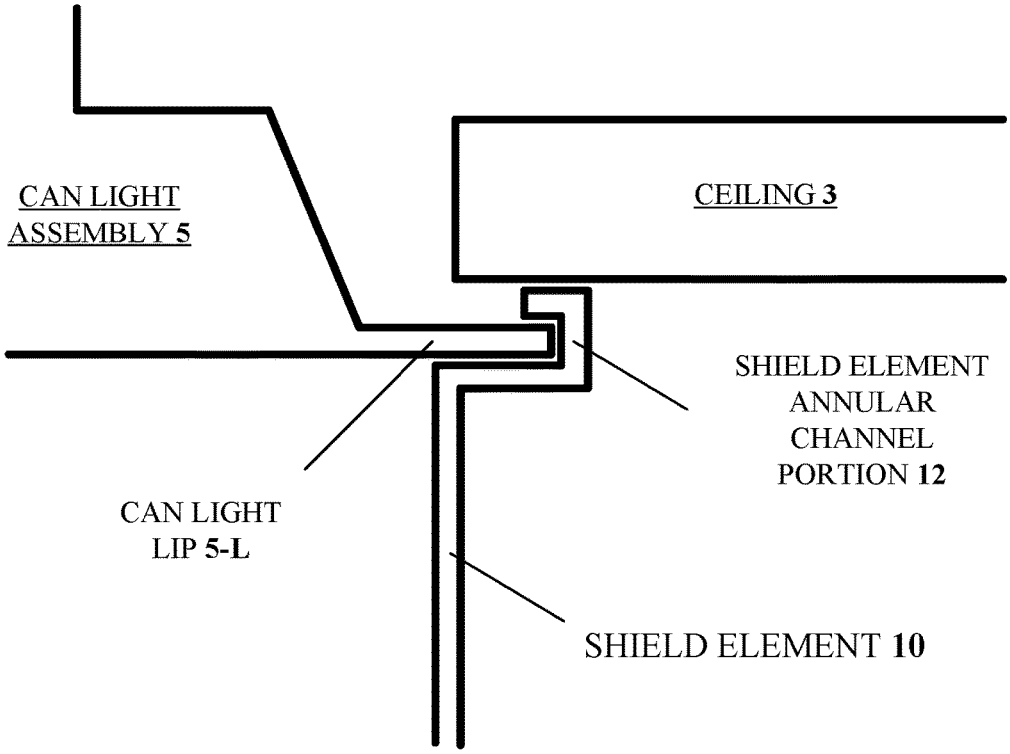
FIG. 8 is a detailed view of that shown in FIG. 3. Shown is a can light assembly 5 which is mounted as typically done in the ceiling 3 of a typical dwelling such as but not limited to a residential home. The can light assembly 5 includes an annular, outwardly directed circular lip 5-L at its lower portion, namely the portion that typically extends downwardly from the downwardly directed surface of ceiling 3. Attached to the lip 5-L is the inwardly directed annular shield channel portion 12 of the shield element 10. It may be understood that this engagement facilitates the rotation of the shield element about its vertical center axis, such that shielding may be positioned about a 360 degree range. It may also be understood that some pressure and/or manipulation may be needed to fit the element in place if there is a snug fit of the can light assembly.
Figure 9:
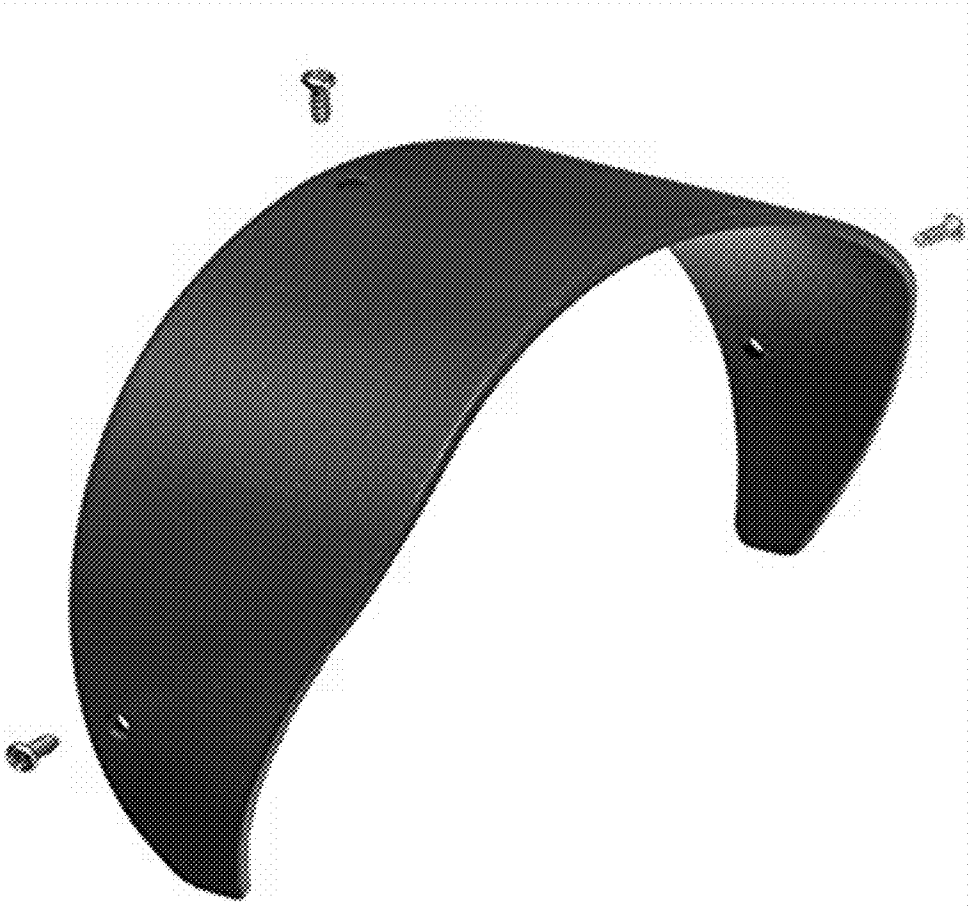
Fig. 9 Prior art
FIG. 9 is a prior art configuration.

The shield channel portion 12 snaps onto and fits around the annular lip of the can light assembly 5 which typically protrudes downwardly underneath the surface of a ceiling 3. The shield channel 12 is configured to bend somewhat to allow a "snap" fit as its gap is stretched somewhat as it passes onto and, as it recovers from such stretching, "snaps" back, onto the flange resulting in the fit shown in FIGS. 2B, 3, and 8. This shielding channel 12 may also be referenced as an attachment portion 12.

The shielding wall 14 is substantially opaque, and provides shielding of direct light coming out of the can light 5. The longest side of the wall is configured to provide the most shielding, and the side opposite of longest side is the side of its gap. Thus it may be understood that shield element may be rotated about its vertical center axis, such that directional shielding may be infinitely adjusted within a 360 degree range about its vertical center axis. This shielding wall may also be known as a shielding portion 14. Its gap could also be referenced as a gap in an otherwise annular circumference, this gap being in substantial alignment with the gap in the shield channel portion 12.

Shield Element 10 Installation and Adjustment

The shield element 10 may be easily installed and adjusted as needed. Reference is again made to FIG. 1, which illustrates installation of the shield element 10 onto a can light assembly 5 installed in a ceiling having a downwardly directed planar surface 3 such as that provided by sheetrock or other suitable paneling. The dotted line shows the install direction as the shield element 10 is snapped into place onto a can light assembly 5.

As noted elsewhere the shield channel portion 12 snaps onto and fits around the annular lip of the can light assembly 5, which typically protrudes downwardly underneath the surface of a ceiling 3. More specifically, the stationary recessed can light includes a lower annular lip 5-L having a substantially circular outer free edge, which is typically not fixed to the ceiling, thus allow the shield channel portion to be attached thereto. The shield channel portion 12 is configured to bend somewhat to allow a "snap" fit as its gap is stretched somewhat as it passes onto and snaps onto the flange resulting in the fit shown in FIGS. 2B, 3, and 8. Said another way, the shield element includes an inwardly directed annular channel portion 12 configured to fit around the exterior lip of the outer free edge of the can light, the circular exterior lip and the annular channel portion mating together to facilitate a connection as well as to facilitate rotational sliding between the two.

Figure 2A:
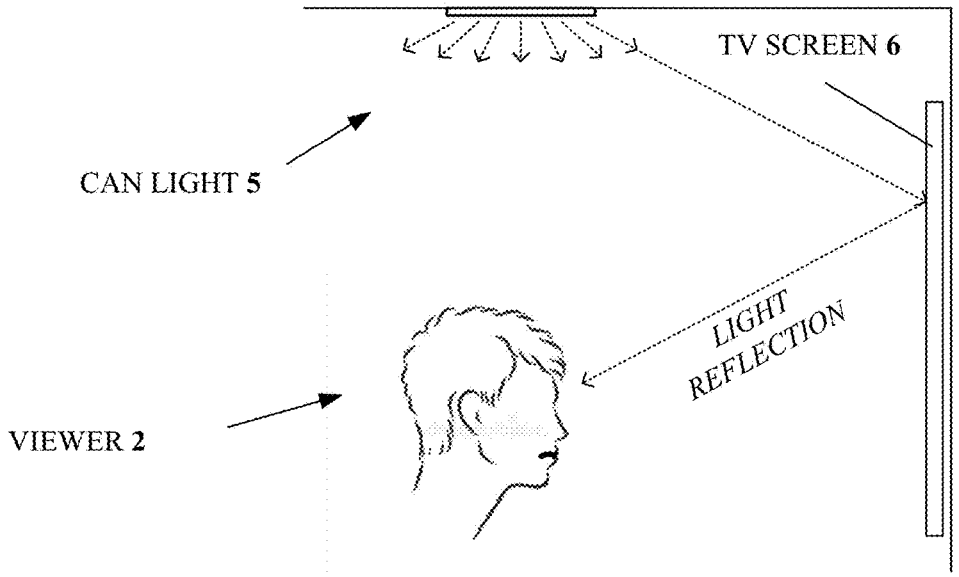
Fig. 2A PRIOR ART
FIGS. 2A and 2B are views illustrating the benefit of the present configuration according to an embodiment of the present invention.
Figure 2B:
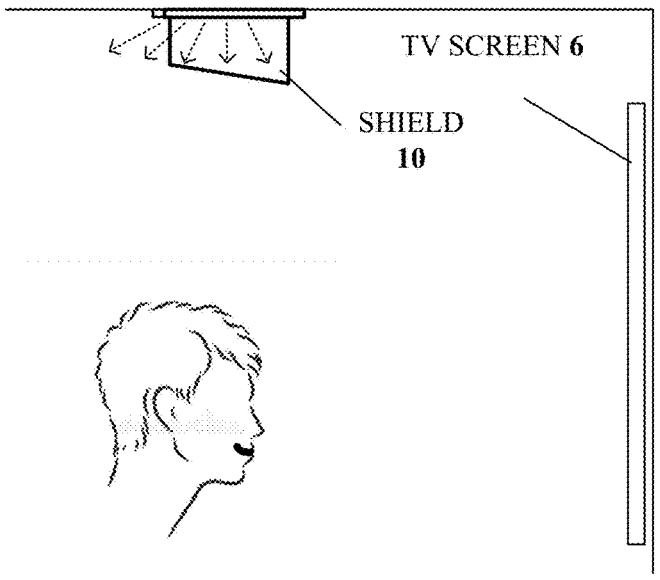

Note that the position of the shield element 10 may be infinitely adjusted in a rotational manner by rotation of the shield element about its vertical center axis such that the highest side of the shielding wall may be positioned as desired within a 360 degree range. FIGS. 2A and 2B are views illustrating the benefit of this adjustment according to an embodiment of the present invention. Said another way, rotation of the attachment provides directionally adjustable shielding from direct illumination of the can light 5.

FIG. 2A shows the use of an overhead can light 5 without any shielding, with light reflecting from a wall mounted TV screen 6 or other similarly oriented reflective surface, to the detriment of the typical viewer 2. It may be understood that in this situation, the light provides direct illumination into an illumination zone, part of which reflects in the reflective surface.

FIG. 2B shows the use of the shield element 10 according to an embodiment of the present invention, said shield including a portion blocking light which would ordinarily reflect from a wall mounted TV screen 6 or other similarly oriented reflective surface, thus providing an improved experience for the typical viewer 2. It may be understood that the lowest part of the shield element 10 is directed to the viewer's right in this figure, and the gap, discussed elsewhere, is to the viewer's left in this figure. It may be understood that in this situation, the shield element 10 blocks the direct illumination of said light that reflects in the reflective surface. Said another way, a shielding portion of the attachment acts as a shield to block direct illumination into a given section of the direct illumination zone of the light. In this case the shielding portion includes a downwardly directed lower lip.

Materials and Dimensions

Materials selected to allow the shield element 10 to provide a "snap" fit to the can light assembly 5 may be used according to the those known in the art, including but not limited to:

Polyethylene
Acrylonitrile Butadiene Styrene (ABS)
Polycarbonate
Nylon
Polystyrene
Polypropylene It should be understood that various dimensions may be used without departing from the spirit and scope of the present invention, as long as the desired shielding effect is provided for a given can light model and/or size.

Figure 7:
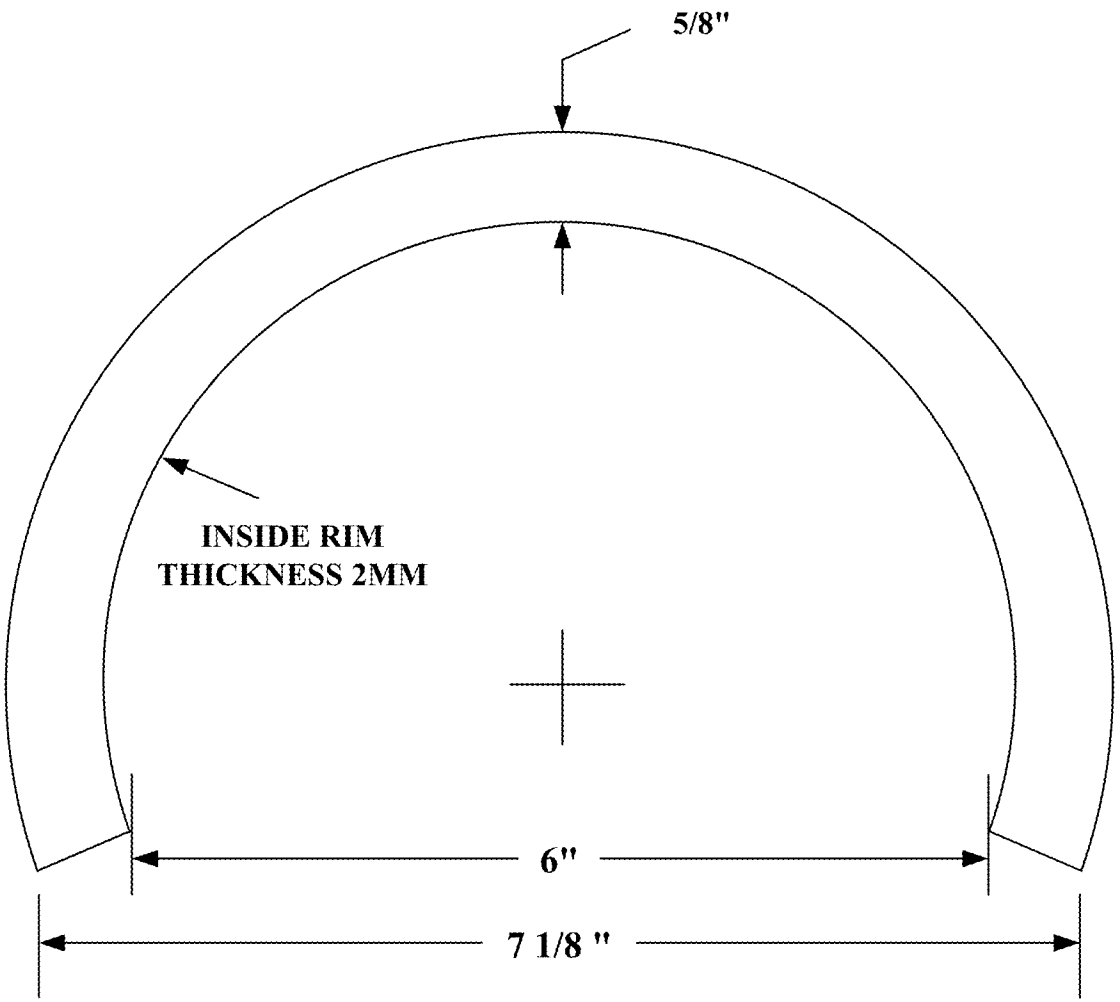
FIG. 7 is a bottom plan view of the shield element 10, showing various dimensions which may vary on model, as described elsewhere. This configuration is for a^ inch can light.

It is contemplated that the shield element 10 to can fit on can lighting of various sizes, including but not limited to 4 or 6 inch configurations. The dimensions shown in FIG. 7 are for a six (6) inch light.

Variations and Options

As noted earlier, it is contemplated that the shield element 10 to can fit on can lighting of various sizes, including but not limited to 4 or 6 inch configurations. The dimensions shown in FIG. 7 are for a six (6) inch light.

CONCLUSION

Various modifications and variations can be made in the present invention without departing from the spirit or scope of the invention.

From the foregoing, it will be seen that this invention is one well adapted to obtain all the ends and objects herein set forth, together with other advantages which are obvious, and which are inherent to the structure.

It will be understood that certain features and sub combinations are of utility and may be employed without reference to other features and sub combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention claimed is:

1. An attachment element configured to be attached to a stationary recessed overhead can light, said light providing direct illumination into an illumination zone, said stationary recessed can light including a lower annular lip having a substantially circular outer free edge, said attachment element comprising:

A) a shielding portion configured to shield a portion of said light,

B) an attachment portion configured to attach to said recessed overhead can light, said attachment portion including an inwardly directed annular channel portion configured to fit around the exterior of said outer free edge of said can light, said circular lip and said annular channel mating together to facilitate a connection as well as to facilitate rotational sliding between the two, such that said shielding portion while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment portion is in said first rotational position, said shielding portion of said attachment element acts as a shield to block direct illumination into a given section of said illumination zone, such that when said attachment portion is in said second rotational position, said shielding portion of said attachment element does not act as a shield to block direct illumination into said given section of said illumination zone, such that rotation of said attachment portion provides directionally adjustable shielding from said illumination.

2. The attachment element configured to be attached to a stationary recessed overhead can light as claimed in claim 1, wherein said shielding portion is a portion of a tube including a longitudinal center axis, wherein said free edge lies in a common plane that is not perpendicular to said center axis, but is instead at an acute angle to such a perpendicular plane.

3. The attachment element configured to be attached to a stationary recessed overhead can light as claimed in claim 1, said can light being installed within a ceiling defining a downwardly directed ceiling surface, wherein said shielding portion includes a longer portion that when in an installed position extends further downwardly relative to and away from said ceiling surface than the remainder of said attachment, said longer portion providing said directionally adjustable shielding.

4. The attachment element configured to be attached to a stationary recessed overhead can light as claimed in claim 1, wherein said rotation may be provided by manual adjustment.

5. The attachment element configured to be attached to a stationary recessed overhead can light as claimed in claim 4, wherein said attachment element may be used with 4 or 6 inch overhead can lights.

6. The attachment element configured to be attached to a stationary recessed overhead can light as claimed in claim 1, wherein said attachment element may be used with 4 or 6 inch overhead can lights.

7. An attachment element configured to be attached to a stationary recessed overhead can light, said light providing direct illumination into an illumination zone, said stationary recessed can light including a lower annular lip having a substantially circular outer free edge, said attachment element comprising:

A) a shielding portion configured to shield a portion of said light, said shielding portion having a substantially cylindrical shape except for a gap in its circumference running the length of the shielding portion; and B) an attachment portion configured to attach to said recessed overhead can light, said attachment portion including an inwardly directed truncated annular channel portion configured to fit around the exterior of said outer free edge of said can light, said circular lip and said annular channel mating together to facilitate a connection as well as to facilitate rotational sliding between the two, such that said shielding portion while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment portion is in said first rotational position, said shielding portion of said attachment element acts as a shield to block direct illumination into a given section of said illumination zone, such that when said attachment portion is in said second rotational position, said shielding portion of said attachment element does not act as a shield to block direct illumination into said given section of said illumination zone, such that rotation of said attachment portion provides directionally adjustable shielding from said illumination, said attachment portion having a gap in its circumference being in substantial alignment with said gap in said shielding portion, said shielding portion and said attachment portion being flexible to facilitate allow said gap to widened during installation and then to snap back, allowing said attachment portion to be snap-fitted around said widening of said gap allowing for its installation onto said substantially circular outer free edge of said lower annular lip of said stationary recessed can light.

8. The attachment element configured to be attached to a stationary recessed overhead can light as claimed in claim 7, wherein said shielding portion is a portion of a tube including a longitudinal center axis, wherein said free edge lies in a common plane that is not perpendicular to said center axis, but is instead at an acute angle to such a perpendicular plane.

9. The attachment element configured to be attached to a stationary recessed overhead can light as claimed in claim 7, said can light being installed within a ceiling defining a downwardly directed ceiling surface, wherein said shielding portion includes a longer portion that when in an installed position extends further downwardly relative to and away from said ceiling surface than the remainder of said attachment, said longer portion providing said directionally adjustable shielding.

10. The attachment element configured to be attached to a stationary recessed overhead can light as claimed in claim 7, wherein said rotation may be provided by manual adjustment.

11. The attachment element configured to be attached to a stationary recessed overhead can light as claimed in claim 10, wherein said attachment may be used with 4 or 6 inch overhead can lights.

12. The attachment element configured to be attached to a stationary recessed overhead can light as claimed in claim 7, wherein said attachment may be used with 4 or 6 inch overhead can lights.

13. A method of attaching an attachment element configured to be attached to a stationary recessed overhead can light, said light providing direct illumination into an illumination zone, said stationary recessed can light including a lower annular lip having a substantially circular outer free edge, said method comprising:

A) providing a shielding portion configured to shield a portion of said light, said shielding portion having a substantially cylindrical shape except for a gap in its circumference running the length of the shielding portion; and B) providing an attachment portion configured to attach to said recessed overhead can light, said attachment portion including an inwardly directed truncated annular channel configured to fit around the exterior of said outer free edge of said can light, said circular lip and said annular channel mating together to facilitate a connection as well as to facilitate rotational sliding between the two, such that said shielding portion while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment portion is in said first rotational position, said shielding portion of said attachment element acts as a shield to block direct illumination into a given section of said illumination zone, such that when said attachment portion is in said second rotational position, said shielding portion of said attachment element does not act as a shield to block direct illumination into said given section of said illumination zone, said attachment portion having a gap in its circumference being in substantial alignment with said gap in said shielding portion, said shielding portion and said attachment portion being flexible to facilitate allow said gap to widened during installation and then to snap back, allowing said attachment portion to be snap-fitted around said widening of said gap allowing for its installation onto said substantially circular outer free edge of said lower annular lip of said stationary recessed can light, and C) rotating said attachment such that it provides directionally adjustable shielding from said illumination.

14. A method of attaching an attachment element configured to be attached to a stationary recessed overhead can light, said light providing direct illumination into an illumination zone, said stationary recessed can light including a lower annular lip having a substantially circular outer free edge, said method comprising:

A) providing a shielding portion configured to shield a portion of said light; and B) providing an attachment portion configured to attach to said recessed overhead can light, said attachment portion including an inwardly directed annular channel configured to fit around the exterior of said outer free edge of said can light, said circular lip and said annular channel mating together to facilitate a connection as well as to facilitate rotational sliding between the two, such that said shielding portion while attached can rotate around said stationary can light about a rotational axis while the said light remains stationary, such that said rotational capability facilitates the positioning of said shielding portion in a plurality of rotational positions relative to said light, said plurality of rotational positions including a first rotational position, and a second rotational position, such that when said attachment portion is in said first rotational position, said shielding portion of said attachment element acts as a shield to block direct illumination into a given section of said illumination zone, such that when said attachment portion is in said second rotational position, said shielding portion of said attachment element does not act as a shield to block direct illumination into said given section of said illumination zone; and C) rotating said attachment such that it provides directionally adjustable shielding from said illumination.

* * * * *